United States Patent [19]

Suzuki

[11] Patent Number: 4,848,638

[45] **Date of Patent: * Jul. 18, 1989**

[54] PUNCH ASSEMBLY

[75] Inventor: Takeshi Suzuki, Toyama, Japan

[73] Assignee: Yoshida Kogyo K. K., Tokyo, Japan

[ * ] Notice: The portion of the term of this patent subsequent to Apr. 12, 2005 has been disclaimed.

[21] Appl. No.: 88,245

[22] Filed: Aug. 24, 1987

[30] Foreign Application Priority Data

Aug. 26, 1986 [JP] Japan ..... 61-129899

[51] Int. Cl.[4] ..... B25C 7/00

[52] U.S. Cl. ..... 227/149; 227/30

[58] Field of Search ..... 227/15, 30, 31, 124, 227/149, 153; 83/699, 684

[56] References Cited

U.S. PATENT DOCUMENTS 2,932,029 4/1960 De Nicolo ..... 269/254 R
4,454,650 6/1984 Silver ..... 227/149
4,736,880 4/1958 Sodeno ..... 227/149

FOREIGN PATENT DOCUMENTS 2059746 9/1979 United Kingdom .
2152867A 12/1984 United Kingdom .

*Primary Examiner*—Frank T. Yost
*Assistant Examiner*—James L. Wolfe
*Attorney, Agent, or Firm*—Hill, Van Santen, Steadman & Simpson

[57] ABSTRACT

A punch assembly comprising a cylindrical clamper holder, a ram reciprocatingly movable therein and having an axial bore, a punch carried on the ram, a pair of clampers pivotally mounted on the clamper holder and releasably holding a fastening element, a pair of washers received in a lateral slot in the clamper holder and resiliently urged against the ram by springs, and a bolt-and-nut unit extending transversely through the axial bore of the ram and fastening the springs and the washers together.

2 Claims, 2 Drawing Sheets

PUNCH ASSEMBLY

BACKGROUND OF THE INVENTION

1. Field of the Invention:

This invention relates to a punch assembly for applying snap fasteners, buttons, ornamental marks, or the like to workpieces such as garment fabrics.

2. Description of the Prior Art:

Punch assemblies of this character are known for joining together a pair of fastening elements by driving one such element through a workpiece into the other element. A typical example of such punch assembly is disclosed in Japanese Utility Model Laid-Open Publication No. 62-83830 Issued May 28, 1987, corresponding to U.S. Pat. No. 4,736,880 which assembly comprises a clamp holder, a pair of clamps pivotally mounted thereon for releasably holding one of the fastener elements, a punch holder slidably received in the clamp holder and connected at one end to a reciprocable ram and at the other end to a punch. The clamp holder is divided into identical halves which are normally urged toward each other; i.e. against the punch holder by a pair of spring members whose tension is controlled so as to impose a predetermined amount of braking or damping force upon the clamp holder relative to the punch holder whereby the danger of impairing the workpiece under excessive impinging stress is eliminated.

However, the prior punch assembly has a drawback in that the divided halves of the clamp holder are prone to shift out of position relative to each other after prolonged use, allowing the fastening element to fall off or making it otherwise difficult to hold the same in the proper position registering with the mating element underlying the workpiece.

SUMMARY OF THE INVENTION

It is therefore the primary object of the invention to provide improvements in and relating to the foregoing prior punch assembly whereby the aforementioned drawback will be overcome.

According to the present invention, a punch assembly comprises a cylindrical chamber holder, a ram reciprocatingly movable therein and having an axial hole, a punch carried on said ram, a pair of clampers pivotally mounted on said clamper holder and releasably holding a fastener element, a pair of washers received in a lateral slot in said clamper holder and resiliently urged against said ram by resilient means, and a bolt-and-nut extending transversely through the axial bore of the ram.

This and other objects and features of the invention will be more apparent from the following detailed description taken in connection with the accompanying drawings.

DETAILED DESCRIPTION OF THE INVENTION

Figure 1:
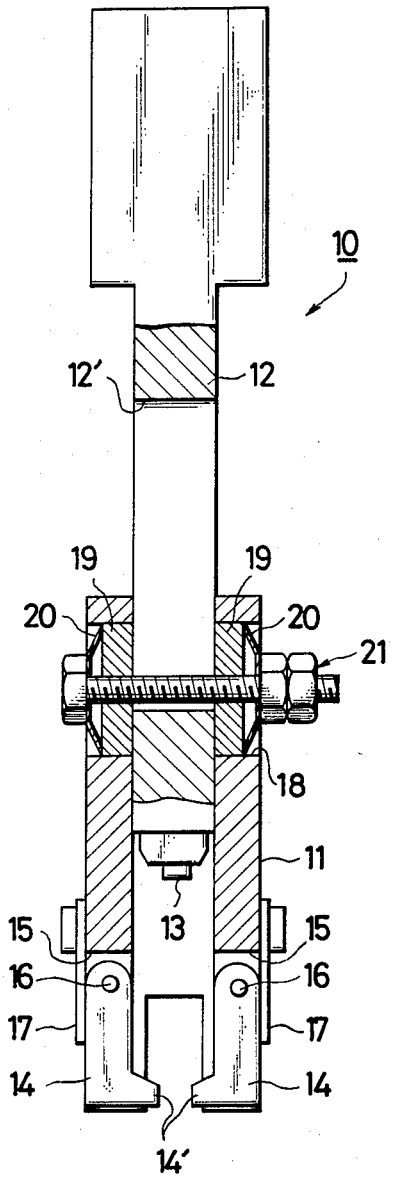
FIG. 1 is a front elevational, partly sectional, view of a punch assembly embodying the invention, illustrating the same in standby position.

Referring now to the drawings, there is shown a punch assembly 10 embodying the invention which essentially comprises a clamper holder 11 in the form of an integral piece cylinder, a ram 12 carrying a punch 13 and reciprocally received in the clamper holder 11, and a pair of clampers 14 having confronting jaws 14' and pivotally connected to the clamper holder 11 for releasably holding one of two mating fastening elements not shown.

The cylindrical clamper holder 11 has at its lower end a pair of recesses 15 in which the pair of clampers 14 are pivotally mounted through respective pins 16. The clampers 14 are normally held in the upright position by leaf springs 17 as shown in FIG. 1, in which position the fastening element is gripped in place by the jaws 14' of the clampers 14.

The ram 12, which may be hydraulically or pneumatically operated, carries at its lower tip end the punch 13 for driving one fastening element such as a hook button into its associated female counterpart disposed under a substrate such as a garment fabric not shown.

At the upper end portion of the clamper holder 11, there is formed a lateral slot 18 communicating with an axially elongated transverse bore 12' in the ram 12 and receiving a pair of washers 19 which are resiliently borne against the peripheral wall of the ram 12 by the tension of respective dish springs 20. The tension of these springs is adjusted by a bolt-and-nut unit 21 which extends transversely through the axial bore 12' of the ram 12 and which fastens the dish springs 20 and the washers 19 together in place within the slot 18.

Figure 2:
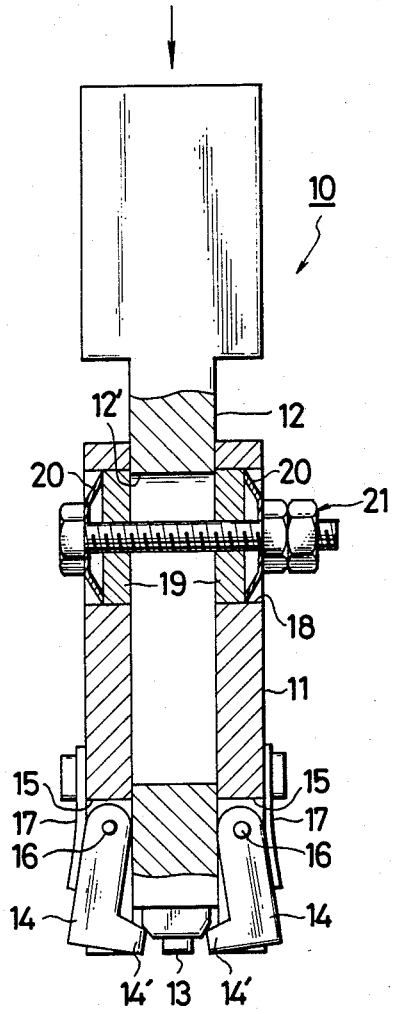
FIG. 2 is a view similar to FIG. 1, but showing the assembly in operative position.

In the operation of the punch assembly 10 thus constructed, a downward stroke of the ram 12 brings the punch 13 into abutting engagement with the fastening element, urging the clampers 14 pivotally away from each other against the tension of the leaf springs 17 as shown in FIG. 2, until the element is released from the jaws 14' and driven through the garment fabric into the mating element. A proper adjustment of the tension of the dish springs 17 applies a braking effect to the downward stroke of the ram 12 thereby eliminating the tendency of the punch 13 to exert excessive impinging forces to the garment fabric which would otherwise occur to damage the fabric.

An upward or retractive stroke of the ram 12 allows the clampers 14 to return to their upright position in FIG. 1 by the restoring action of the leaf spring 17.

The clamper holder 11, being of an integral structure, ensures setting of the fastening element securely and accurately in clamping position between the clampers 14.

Many changes or modifications may be made in the specific form and construction herein advanced as appear apparent to one skilled in the art. As for an example, the dish spring 20 may be equivalently a coil spring.

What is claimed is:

1. A punch assembly comprising a one piece cylindrical clamper holder, a ram reciprocatingly movable therein and having an axially elongated transverse bore, a punch carried on said ram, a pair of clampers pivotally mounted on said clamper holder and releasably holding a fastening element, a pair of washers received in a lateral slot in said clamper holder and resiliently urged against said ram by resilient means, and a bolt-and-nut unit extending transversely through said axial bore of said ram.

2. A punch assembly according to claim 1, wherein said resilient means includes a pair of dish springs, adjustably fastened with said washers by said bolt-and-nut unit and each disposed against an outer surface of the respective washer.

* * * * *